US009152096B2

(12) United States Patent
Kim et al.

(10) Patent No.: US 9,152,096 B2
(45) Date of Patent: Oct. 6, 2015

(54) IMAGE FORMING APPARATUS HAVING COOLING UNIT

(75) Inventors: Gun-wook Kim, Suwon-si (KR); Jin-ho Park, Yongin-si (KR); Kwoang-joe Seorl, Seongnam-si (KR); Byung-jo Lee, Bucheon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 135 days.

(21) Appl. No.: 12/926,691

(22) Filed: Dec. 3, 2010

(65) Prior Publication Data

US 2011/0255895 A1 Oct. 20, 2011

(30) Foreign Application Priority Data

Apr. 15, 2010 (KR) ..... 10-2010-0034935

(51) Int. Cl.
*G03G 21/20* (2006.01)
*G03G 15/20* (2006.01)

(52) U.S. Cl.
CPC ..... *G03G 15/2017* (2013.01); *G03G 21/206* (2013.01)

(58) Field of Classification Search
USPC ..... 399/92
See application file for complete search history.

(56) References Cited

U.S. PATENT DOCUMENTS 6,173,132 B1 * 1/2001 Kida et al. ..... 399/44
2005/0271414 A1 * 12/2005 Katayama et al. ..... 399/93
2006/0045557 A1 * 3/2006 Kim ..... 399/92
2006/0275048 A1 * 12/2006 Nishimura et al. ..... 399/92
2007/0116489 A1 * 5/2007 Kim ..... 399/92
2008/0217556 A1 * 9/2008 Kagawa et al. ..... 250/423 R
2008/0219695 A1 * 9/2008 Doshohda et al. ..... 399/93
2008/0250928 A1 * 10/2008 DeSalvo et al. ..... 96/16
2009/0042502 A1 * 2/2009 Kim et al. ..... 454/139
2009/0290897 A1 * 11/2009 Doshoda et al. ..... 399/93
2011/0085819 A1 * 4/2011 Akagawa ..... 399/93
2011/0116828 A1 * 5/2011 Akagawa ..... 399/92

FOREIGN PATENT DOCUMENTS

JP 2002058731 A * 2/2002
JP 2004-233618 8/2004

(Continued)

OTHER PUBLICATIONS

Extended European Search Report mailed Sep. 2, 2014 in related European Application No. 10196862.6.

*Primary Examiner* — David Gray
*Assistant Examiner* — Tyler Hardman
(74) *Attorney, Agent, or Firm* — Staas & Halsey LLP

(57) ABSTRACT

An image forming apparatus including: a body housing; a paper feeding unit accommodated in the body housing and providing a recording medium; an image forming unit accommodated in the body housing and forming an image on the recording medium; a fixing unit accommodated in the body housing and fixing the image formed by the image forming unit; and a cooling unit including a channel including an inhalation part and a discharging part which are formed in the body housing for air to flow, extending between the inhalation part and the discharging part and formed adjacently to the fixing unit, and an air purification module installed in the channel and generating ions reacting to foreign substances in air traveling through the channel to purify the air, and discharging heat generated in the fixing unit to the outside.

15 Claims, 7 Drawing Sheets

(56) References Cited

FOREIGN PATENT DOCUMENTS

| | | | | |
|---|---|---|---|---|
| JP | 2004233618 | A | * | 8/2004 |
| JP | 2005071715 | A | * | 3/2005 |
| JP | 2005099505 | A | * | 4/2005 |
| JP | 2007-47496 | | | 2/2007 |
| JP | 2007047496 | A | * | 2/2007 |
| JP | 2008-251514 | | | 10/2008 |
| JP | 2008251514 | A | * | 10/2008 |
| JP | 2010017520 | A | * | 1/2010 |

* cited by examiner

IMAGE FORMING APPARATUS HAVING COOLING UNIT

CROSS-REFERENCE TO RELATED APPLICATIONS

This application claims priority from Korean Patent Application No. 10-2010-0034935, filed on Apr. 15, 2010 in the Korean Patent Office, the disclosure of which is incorporated herein by reference.

BACKGROUND

1. Field

Apparatuses consistent with the exemplary embodiments relate to an image forming apparatus which forms an image on a recording medium with a developing agent, and more particularly, to an image forming apparatus which discharges air rising in temperature by heat generated in a fixing unit out of the apparatus.

2. Description of the Related Art

An image forming apparatus is generally realized as a printer, a copy machine, a fax, a multifunctional device having two or more functions, etc. and conducts a printing process of forming a visible image on a recording medium with a developing agent or ink. An image forming apparatus employing a developing agent includes an image forming unit which forms a visible image on a recording medium by a developing agent and a fixing unit which fixes an image formed by the image forming unit on a recording medium.

Such an image forming apparatus necessarily generates heat therein in a printing process, and high-temperature air in the apparatus is discharged out of the apparatus through a vent formed at one side of the apparatus.

However, the inside of the image forming apparatus is generally blocked from the outside. Inside the image forming apparatus phenomena including heat and dust from several components and the developing agent are generated. These phenomena cause microorganisms such as bacteria, fine dust or nano-dust to accumulate in the apparatus. These microorganisms or fine dust are discharged from the inside of the image forming apparatus to the outside through the vent, thereby bring about air contamination in use environments.

In the image forming apparatus, temperature is the highest around the fixing unit which emits heat for fixing, and density of microorganisms and fine dust in the air is generally high near the fixing unit as well.

SUMMARY

Accordingly, one or more exemplary embodiments provide an image forming apparatus which effectively releases high-temperature air around a fixing unit out of the apparatus to cool down the fixing unit and discharges purified air by eliminating microorganisms and fine dust from the released air out of the apparatus.

The foregoing and/or other aspects may be achieved by providing an image forming apparatus including: a body housing; a paper feeding unit accommodated in the body housing and providing a recording medium; an image forming unit accommodated in the body housing and forming an image on the recording medium; a fixing unit accommodated in the body housing and fixing the image formed by the image forming unit; and a cooling unit which discharges heat generated in the fixing unit to the outside, the cooling unit including a channel including an inhalation part and a discharging part which are formed in the body housing for air to flow, extending between the inhalation part and the discharging part and formed adjacently to the fixing unit, and an air purification module installed in the channel and generating ions reacting to foreign substances in air traveling through the channel to purify the air.

The air purification module may be installed in the discharging part formed at one end portion of the channel so that the air in the channel is discharged out of the body housing.

The fixing unit may include a heating roller generating heat, and the channel may be formed to extend in a lengthwise direction of the heating roller adjacently to the heating roller.

The air purification module may include a cation generating unit producing cations and an anion generating unit installed distantly from the cation generating unit in a direction of air traveling and producing anions.

The anion generating unit may emit an electron to generate superoxide (O2−).

The cation generating unit may generate a hydrogen ion (H+).

The air purification module may produce a hydrogen atom (H) by operating both the cation generating unit and the anion generating unit.

The air purification module may produce a hydrogen atom and superoxide, and may produce hydroperoxy radical (HO2) with the hydrogen atom and the superoxide.

The image forming apparatus may include a user input unit provided to select whether to produce cations and anions by the air purification module and to adjust an amount of ions generated.

The channel may be formed in a substantial straight line.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION

Figure 1:
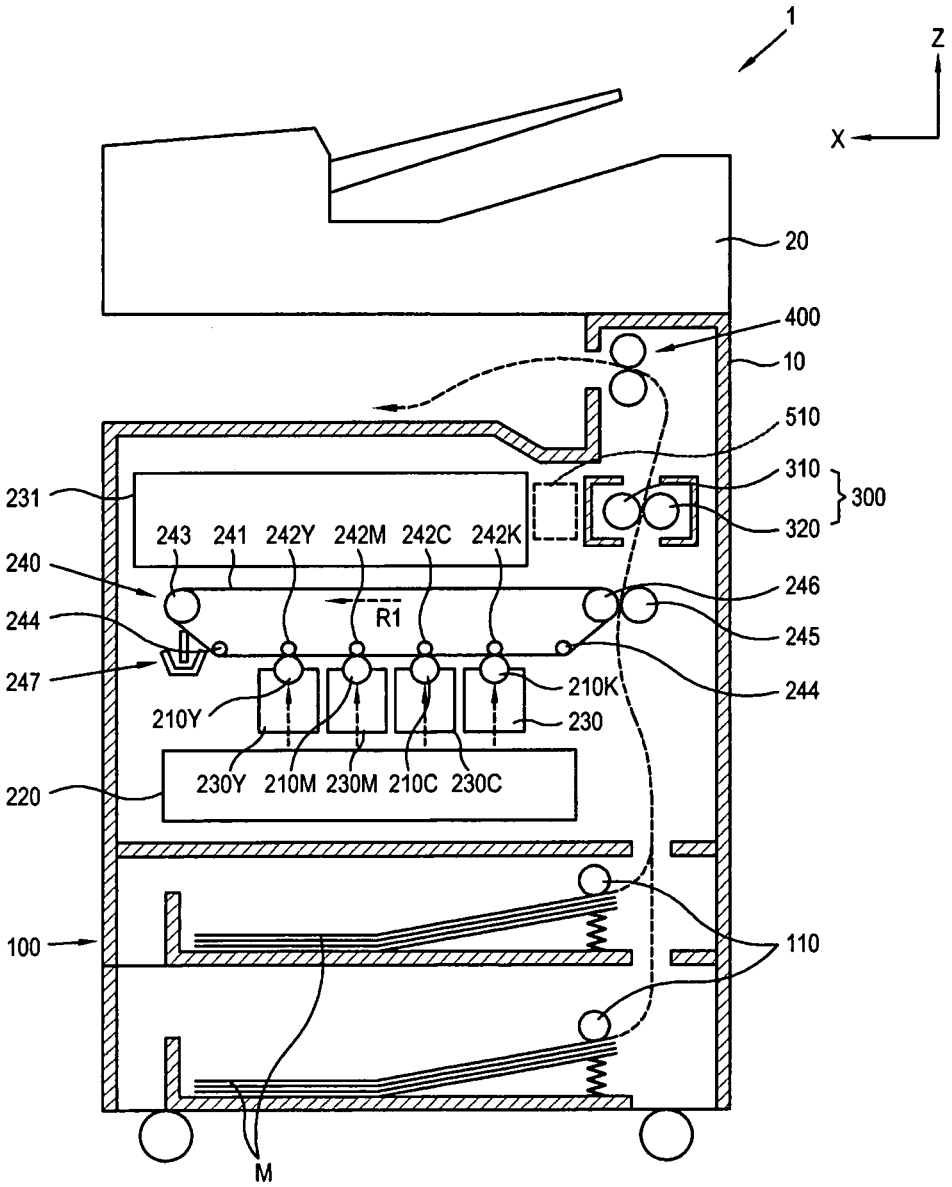
FIG. 1 is a lateral cross-sectional view of an image forming apparatus according to one exemplary embodiment.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

FIG. 1 is a lateral cross-sectional view of an image forming apparatus 1 according to one exemplary embodiment.

As shown in FIG. 1, the image forming apparatus 1 according to the present embodiment is explained as a copier capable of generating color images, but the scope of the present inventive concept may be applicable to a printer, a multi-function printer (MFP), etc., which form images on a recording medium.

Directions shown in drawings are defined. Basically, X, Y, and Z directions indicate the width, length, and height directions, respectively, and the opposite X, Y, and Z directions are expressed as −X, −Y, and −Z directions, respectively. The X direction is a direction in which a recording medium (M) is discharged out of the image forming apparatus 1, the Y direction is a direction perpendicular to the X direction, and the Z direction is a direction perpendicular to both X and Y directions.

The image forming apparatus 1 of the present embodiment includes a body housing 10 forming an outward appearance of the apparatus, a scanning unit 20 scanning a document to obtain a scanned image, a paper feeding unit 100 picking up and providing a piece of a recording medium (M), an image forming unit forming an image on a recording medium (M) provided from the paper feeding unit 100 with a developing agent, a fixing unit 300 fixing an image on a recording medium (M) by heat and pressure, a medium discharging unit 400 discharging a recording medium (M) on which an image is fixed out of the body housing 10.

The image forming unit includes an image holding member 210Y, 210M, 210C, and 210K forming an electrostatic latent image and a visible image thereon, an exposure unit 220 exposing the image holding member 210Y, 210M, 210C, and 210K to form an electrostatic latent image, a developing unit 230Y, 230M, 230C, and 230K providing a developing agent to an electrostatic latent image of the image holding member 210Y, 210M, 210C, and 210K to form a visible image, and a transfer unit 240 transferring a visible image of the image holding member 210Y, 210M, 210C, and 210K to a recording medium (M) in an intermediate transfer type. According to the present embodiment, the image forming apparatus 1 is realized in a single-pass method which involves a plurality of image holding members 210Y, 210M, 210C, and 210K corresponding to respective colors of developing agents, but not limited thereto.

Hereinafter, each component is explained.

The scanning unit 20 scans a document to generate a scanned image of the document. The scanning unit 20 is implemented in a hybrid method, allowing scanning a document which is fixed in position or a document being transferred. The scanning unit 20 transfers a generated scanned image to the image forming unit to form into an image on a recording medium (M) or to a host (not shown) connected locally or through a network with the image forming apparatus 1.

When a plurality of recording media (M) are loaded and a printing process starts, the paper feeding unit 100 picks up a piece of paper among the recording media (M) loaded using a pickup roller 110 and transfers it to the image forming unit. The paper feeding unit 100 includes a plurality of pickup rollers 110 corresponding to loading positions of recording media (M), thereby selectively feeding recording media (M) in each position. The paper feeding unit 110 may be installed in the body housing 10 or provided as an option box combined with an outside of the body housing 10 to feed a recording medium (M) into the body housing 10.

The image holding members 210Y, 210M, 210C, and 210K are realized as a photosensitive body which is capable of forming a potential difference on the surface by electric charge and exposure. In the single-pass method, a plurality of image holding members 210Y, 210M, 210C, and 210K of different colors are provided and disposed parallel with each other. According to the present embodiment, the image holding members 210Y, 210M, 210C, and 210K correspond to four colors, respectively, i.e., yellow, magenta, cyan, and black.

The image holding members 210Y, 210M, 210C, and 210K form an electrostatic latent image based on an image data by each color thereon by the exposure unit 220. When supplying a developing agent to the electrostatic latent image, the developing agent is selectively attached to the surface of the image holding members 210Y, 210M, 210C, and 210K according to a potential difference, so that the image holding members 210Y, 210M, 210C, and 210K form a visible image thereon by the developing agent.

The exposure unit 220 radiates a light beam onto the image holding members 210Y, 210M, 210C, and 210K uniformly charged on the basis of an image data by each color, thereby forming an electrostatic latent image on the image holding members 210Y, 210M, 210C, and 210K. The exposure unit 220 may be realized as a light scanning unit which includes a light source (not shown), a polygon lens (not shown), and a variety of optical lenses (not shown).

A plurality of developing units 230Y, 230M, 230C, and 230K are installed to correspond to the image holding members by colors 210Y, 210M, 210C, and 210K, respectively. The developing units 230Y, 230M, 230C, and 230K store developing agents by colors therein and provide them to the image holding members 210Y, 210M, 210C, and 210K, respectively to form visible images by colors on the respective image holding members 210Y, 210M, 210C, and 210K.

The developing units 230Y, 230M, 230C, and 230K are provided with a developing agent container 231 separately installed to supply a developing agent to the developing units 230Y, 230M, 230C, and 230K as a developing agent stored in the developing units 230Y, 230M, 230C, and 230K is consumed. The developing units 230Y, 230M, 230C, and 230K are realized by a cartridge which is detachable from the body housing 100 to be replaceable.

The transfer unit 240 intermediately transfers visible images by colors on the image holding members 210Y, 210M, 210C, and 210K to overlap with each other at first and then finally transfers the intermediately transferred visible images to a recording medium (M).

The transfer unit 240 includes an intermediate transfer belt 241 coming in contact with the image holding members 210Y, 210M, 210C, and 210K and moving like an endless track, a plurality of intermediate transfer roller 242Y, 242M, 242C, and 242K installed to correspond to the image holding members 210Y, 210M, 210C, and 210K, respectively, with the intermediate transfer belt 241 being interposed therebetween, a driving roller 243 rotating to move the intermediate transfer belt 241, a tension roller 244 providing tension to the intermediate transfer belt 241, a final transfer roller 245 installed in a transfer route of a recording medium (M) in a spot of being in contact with the intermediate transfer belt 241, a backup roller 246 backing up the intermediate transfer belt 241 against the final transfer roller 245, and a cleaning unit 247 installed to be in contact with an outside of the intermediate transfer belt 241.

In a printing process, the intermediate transfer belt 241 rotates by rotation of the driving roller 243. For one cycle in which the intermediate transfer belt 241 makes one rotation, the respective intermediate transfer rollers 242Y, 242M, 242C, and 242K intermediately transfer visible images by colors on the respective image holding members 210Y, 210M, 210C, and 210K to an outer surface of the intermediate transfer belt 241 to overlap with one another. Here, visible images of yellow, magenta, cyan, and black are sequentially intermediately transferred according to a rotating direction of the intermediate transfer belt 241.

The final transfer roller 245 transfers a final color image, intermediately transferred to the intermediate transfer belt 241, to a recording medium (M).

The cleaning unit 247 cleans a waste developing agent or a remaining developing agent on the intermediate transfer belt 241 which is not transferred to a recording medium (M) in the transfer process. The cleaning unit 247 cleans a remaining developing agent on the intermediate transfer belt 241 and collects the remaining developing agent in a separately installed container (not shown).

The fixing unit 300 includes a heating roller 310 generating heat and a pressing roller 320 forming a nip between itself and the heating roller 310. The pressing roller 320 is disposed parallel with the heating roller 310 and pressed by a certain degree of elastic force against the heating roller 310. Accordingly, the nip formed between the heating roller 310 and the pressing roller 320 is given heat and pressure, and an image is fixed while a recording medium (M) on which the image is formed passes the nip.

With this structure of the image forming apparatus 1, when conducting a printing process, heat is generated due to operation of the foregoing components in the body housing 10 to increase temperature in the body housing 10. In particular, the heating roller 310 of the fixing unit 300 itself generates heat for fixing, and so an adjacent area to the heating roller 310 shows the highest temperature in the body housing 10.

In the present embodiment, a channel 510 is formed in a lengthwise direction of the heating roller 310 to be adjacent to the heating roller 310 in order to effectively cool down the heating roller 310. As a method of forming the channel 510 is not limited, an air duct may be installed along the heating roller 310, or various structures in the body housing 10 such as a frame may be formed as the channel 510.

In FIG. 1, the channel 510 is shown to be disposed between the heating roller 310 and the developing agent container 231. The channel 510 communicates with an outside of the body housing 10 at both ends portions. Air introduced from the outside to the channel 510 travels, absorbing heat emitted from the heating roller 310, and discharged to the outside, thereby discharging heat of the heating roller 310 out of the body housing 10. Thus, effect of heat of the heating roller 310 hindering operation of other components in the body housing 10 may be minimally controlled.

However, the inside of the body housing 10 is generally blocked from the outside and is higher in temperature than the outside owing to operation of components. Further, a developing agent is scattered or fine dust such as nano-dust occurs in the inside of the body housing 10 during operation of the image forming apparatus 1. Such various factors allow microorganisms such as bacteria and fine dust to exist in the body housing 10.

Such microorganisms and fine dust are included in air discharged from the channel 510 to cause contamination of use environment of the image forming apparatus 1.

Figure 2:
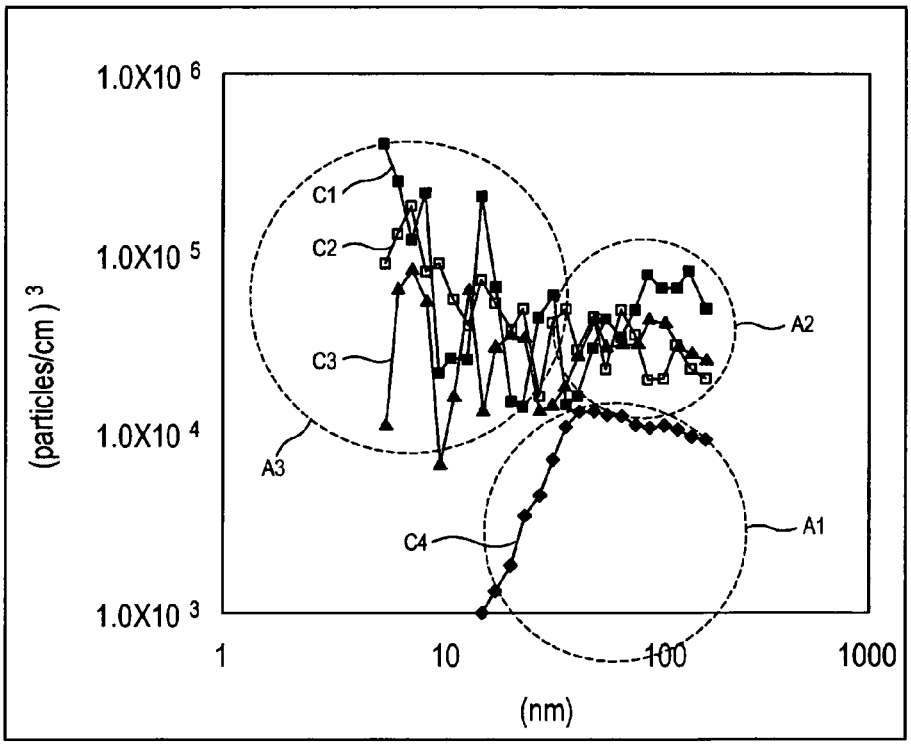
FIG. 2 is a graph illustrating measurement results of fine dust in the channel according to various illustrative operations of the image forming apparatus of FIG. 1.

FIG. 2 is a graph illustrating results of measurement of fine dust happening in the channel 510 according to various illustrative operations of the image forming apparatus 1. Figures given in the graph are a mere measurement data and may be different depending on the image forming apparatus 1 to be measured.

In the graph of FIG. 2, the horizontal axis indicates the diameter of fine dust, and the vertical axis represents the number of fine dust particles per unit area.

Among curves, C1 represents a result of fine dust measured in the channel 510 when the image forming apparatus 1 prints on an initial recording medium (M), C2 represents one when the image forming apparatus 1 warms up or prints in white, and C3 represents one in the case of a general printing process. C4 shows a state of fine dust in the air of use environment of the image forming apparatus 1.

In the graph, area A1 means when a printing process is not conducted, and areas A2 and A3 means when a printing process is carried out. Comparing the respective areas, it is seen that a much greater amount of fine dust happens in the channel 510 when a printing process is performed than in the air. In addition, as shown by area A3, fine dust with relatively small particles occurs in the printing process.

Fine dust is small particles so that it easily floats in the air. Thus, agglomerating fine dust to make the particles relatively large is favorable for elimination. Making fine dust particles large facilitates filtering by an air filter (not shown), and their weight makes it difficult to float in the air.

According to the present embodiment, a cooling unit 500 which includes the channel 510 installed as above to cool heat of the heating roller 310 is applied to the image forming apparatus 1, and it further has an air purification module 540 which agglomerates fine dust included in air discharged from the channel 510 and eliminates microorganisms to purify air. Accordingly, heat of the heating roller 310 is discharged out of the body housing 10, and discharged air is purified to prevent air contamination in the use environment.

Hereinafter, a structure of the cooling unit 500 will be explained with reference to FIG. 3.

Figure 3:
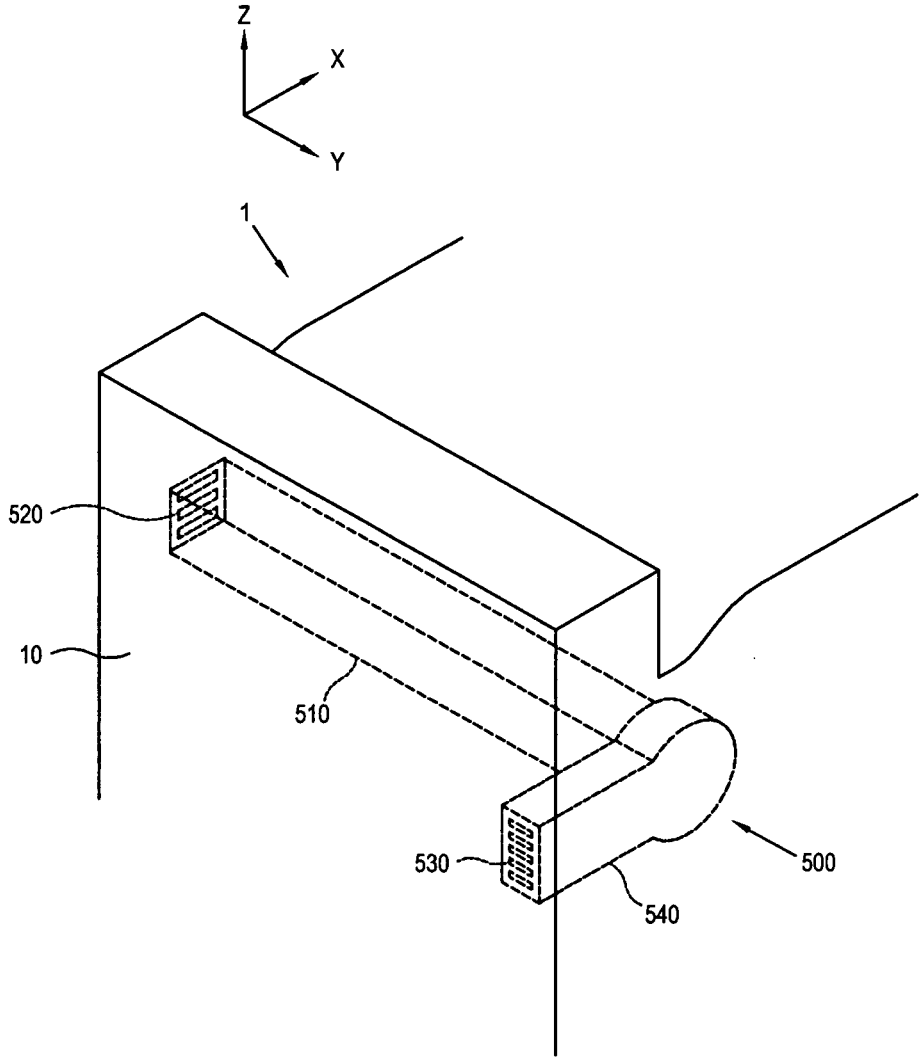
FIG. 3 is a perspective view of a main part schematically showing arrangement of a cooling unit in the image forming apparatus of FIG. 1.

FIG. 3 is a perspective view of a main part illustrating arrangement of the cooling unit 500 in the body housing 10. It should be noted that other components including the scanning unit 20 and the fixing unit 300 are not shown in the drawing to clarify the arrangement of the cooling unit 500.

As shown in FIG. 3, the cooling unit 500 includes the channel 510 formed to extend along the fixing unit 300, more particularly in the lengthwise direction of the heating roller 310 that is the Y direction, an inhalation part 520 formed in the body housing 10 at one end portion of the channel 510 and introducing outside air into the channel 510, a discharging part 530 formed in the body housing 10 at another end portion of the channel 510 and discharging air in the channel 510 to the outside, and the air purification module 540 installed in the channel 510 and purifying air in the channel 510 with ions.

The air purification module 540 may be installed in any position in the channel 510 of a route of air traveling along the channel 510. In the present embodiment, the air purification module 540 is installed in the discharging part 530 to purify air discharged from the discharging part 530 with ions, but it, not limited thereto, may be installed in the channel 510. However, installation of the air purification module 540 in the discharging part 530 may enhance purification effects of air finally discharged from the discharging part 530 as compared with other positions.

In the present embodiment, a route of air discharged from the discharging part 530 is perpendicular to an extending direction of the channel 510 but may be designed variously according to installation structures of the air purification module 540. According to a design, if the discharging part 530 is installed parallel with the extending direction of the channel 510, the air purification module 540 may also be changed in form correspondingly.

The channel 510 extends in a substantial straight line to minimize interference in travel of air introduced from the inhalation part 520, thereby smoothly carrying out heat discharge. The channel 510 is formed adjacently to the heating roller 310 in order that air absorbs heat generated in the heating roller 310, traveling.

The inhalation part 520 and the discharging part 530 are formed as at least one hole penetrating the body housing 10 in order to inhale or discharge air. The inhalation part 520 and the discharging part 530 may have a filter (not shown) to filter off foreign substances from air according to a design.

The air purification module 540 is installed at one end portion of the channel 510 and the discharging part 530 and purifies air discharged from the channel 510 with ions.

In the following, the structure of the air purification module 540 will be described in detail with reference to FIGS. 4 and 5.

Figure 4:
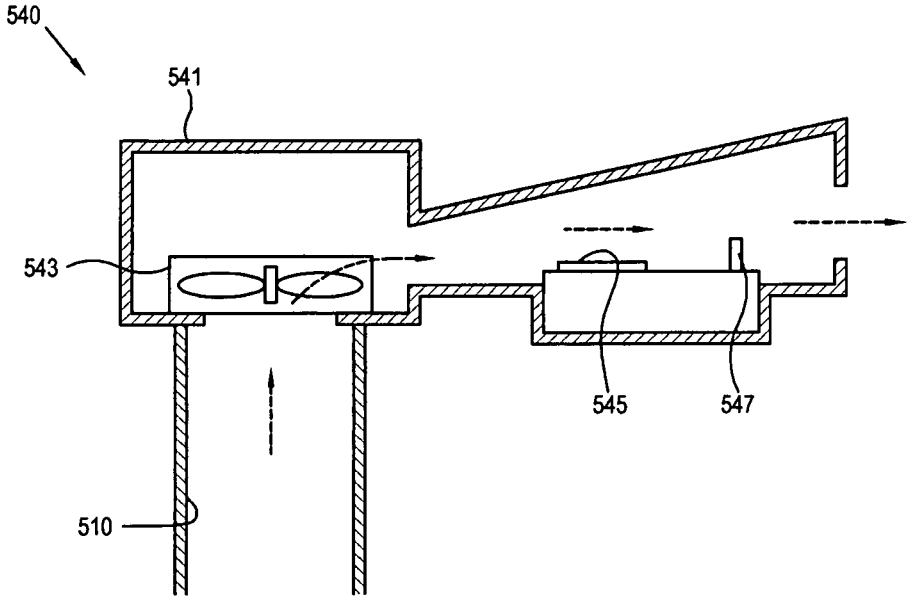
FIG. 4 is a lateral cross-sectional view of an air purification module of a cooling unit in FIG. 3.
Figure 5:
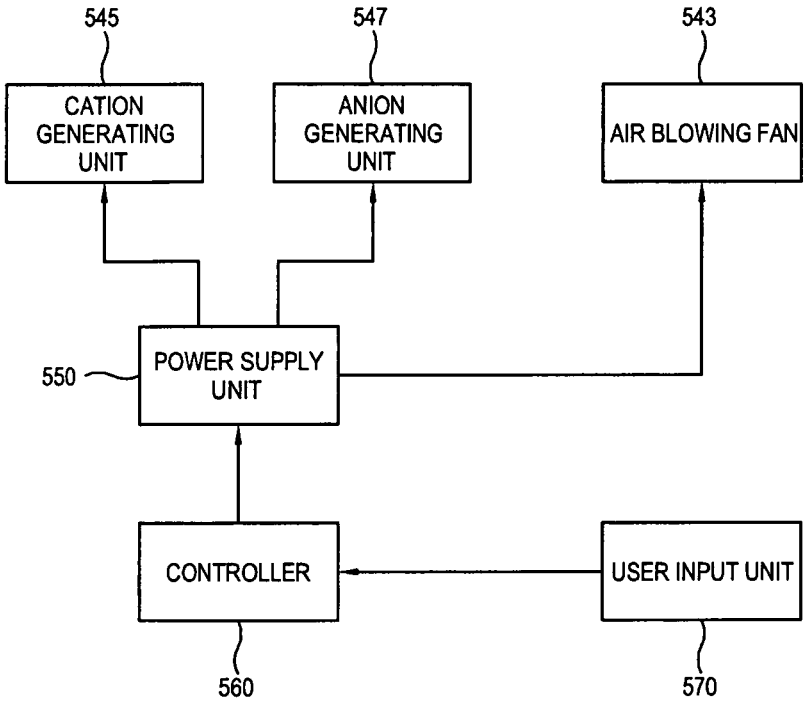
FIG. 5 is a control block diagram of the air purification module of the cooling unit in FIG. 3.

FIG. 4 is a lateral cross-sectional view of the air purification module 540, and FIG. 5 is a control block diagram of the air purification module 540.

As shown in FIGS. 4 and 5, the air purification module 540 is installed at an end portion of the channel 510 in a direction of air in the channel 510 traveling. The air purification module 540 includes a module housing 541 providing an air traveling route therein, an air blowing fan 543 installed in the module housing 541 and operating to transfer air through the channel 510, and an ion generating unit 545 and 547 installed in the air traveling route and generating ions.

Further, the image forming apparatus 1 includes a power supply unit 550 supplying electric power to components including the ion generating unit 545 and 547 and the air blowing fan 543, a controller 560 controlling power supply of the power supply unit 550, and a user input unit 570 installed as a panel outside the body housing 10. In the present embodiment, the power supply unit 550 and the controller 560 of the image forming apparatus 1 supply power to the ion generating unit 545 and 547 to generate ions and control ion generation, but are not limited thereto. A power supply component and a controller may be installed in the air purification module 540 separately from the image forming apparatus 1.

The module housing 541 has an inner space communicating with one end portion of the channel 510 and the discharging part 530 to allow air traveling through the channel 510 to travel to the discharging part 530 via the inside of the module housing 541. In the module housing 541, the air traveling route may be changed variously in design depending on a relative position of the discharging part 530 to the channel 510.

The air blowing fan 543 is installed in the module housing 541 and rotates to transfer air to the discharging part 530. However, this is a merely illustrative example, and air may be allowed to travel naturally without the air blowing fan 543, and at least one air blowing fan 543 may be installed not in the module housing 541 but in any position of the inhalation part 520, the discharging part 530, or the channel 510.

The ion generating unit 545 and 547 includes a cation generating unit 545 which generates positive ions and an anion generating unit 547 which generates negative ions.

The cation generating unit 545 generates positive ions by voltage applied from the power supply unit 550. The cation generating unit 545 causes a plasma discharge to dissociate moisture (H2O) in the air, thereby generating hydrogen ions (H+).

The cation generating unit 545 to generate positive ions is not limited in configuration but may employ various structures. For example, the cation generating unit 545 includes a discharge electrode (not shown) and an induction electrode which are installed distantly from each other and a ceramic plate (not shown) insulating them from each other, generating a plasma discharge in the ceramic plate (not shown) by voltage applied between the discharge electrode (not shown) and the induction electrode (not shown).

The anion generating unit 547 generates negative ions by voltage applied from the power supply unit 550. The anion generating unit 547 is formed by any method, but includes for example a needle-shaped electrode (not shown) to emit electrons from an end portion.

Some electrons emitted from the anion generating unit 547 combine with oxygen molecules (O2) in the air to generate anions that are superoxides (O2−).

The anion generating unit 547 is disposed distantly from the cation generating unit 545 in a direction of air traveling in the module housing 541.

Hydrogen ions (H+) generated by the cation generating unit 545 transfer to the anion generating unit 547 along air traveling. Some of the emitted electrons combine with oxygen into superoxides (O2−) around the anion generating unit 547. The other electrons which do not form superoxides (O2−) combine with hydrogen ions (H+) approaching the anion generating unit 547 into hydrogen atoms (H). When the cation generating unit 545 and the anion generating unit 547 both are operated to generate ions, the ion generating unit 545 and 547 produces hydrogen atoms (H) and superoxides (O2−).

That is, in order that the ion generating unit 545 and 547 produces hydrogen atoms (H), the anion generating unit 547 needs installing at a distance from the cation generating unit 545 in a direction of air traveling. Here, an amount of hydrogen ions (H+) converted into hydrogen atoms (H) is changed on a distance between the anion generating unit 547 and the cation generating unit 545. Therefore, a distance between the anion generating unit 547 and the cation generating unit 545 may be modified by a person skilled in the art in consideration of various factors such as an amount of hydrogen ions (H+) generated by the cation generating unit 545, an amount of electrons emitted by the anion generating unit 547, a velocity of moving air by the air blowing fan 543, etc.

The user input unit 570 is provided to select whether to allow the cation generating unit 545 and the anion generating unit to produce cations and anions or to selectively adjust an amount of ions generated through manipulation by a user. The user determines to generate any one of cations and anions or to produce both cations and anions through the user input unit 570. Such selection may be changed depending on which of fine dust and microorganisms are eliminated, which will be explained later.

The controller 560 selects whether to allow the power supply unit 550 to supply power and selectively apply a level of supply power to the cation generating unit 545 and the anion generating unit 547 according to a selection result of the user input unit 570. Accordingly, the controller 560 controls characteristics and an amount of ions generated by the air purification module 540 corresponding to the selection of the user input unit 570.

Hereinafter, a process of purifying air by ions generated by the air purification module 540 will be explained with reference to FIG. 6. In the following exemplary embodiment, both the cation generating unit 545 and the anion generating unit 547 are operated.

Figure 6:
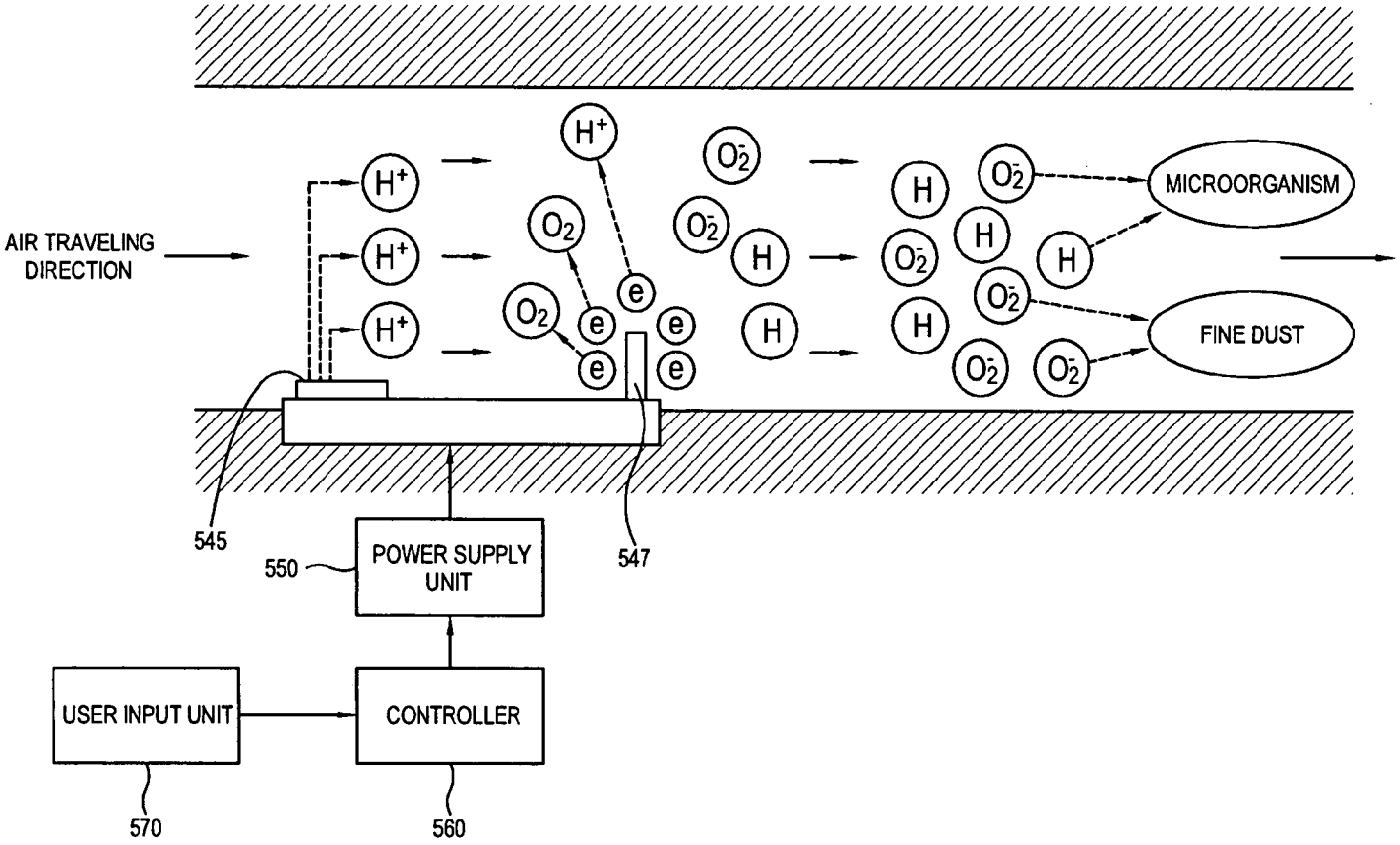
FIG. 6 is a concept view illustrating an example of eliminating microorganisms and fine dust in air by cations and anions generated by the air purification module in FIG. 4.

FIG. 6 is a concept view illustrating an example of eliminating microorganisms and fine dust in traveling air by cations and anions generated by the air purification module 540.

As shown in FIG. 6, when a user selects air purification through the user input unit 570, the controller 560 controls the power supply unit 550 to apply power to the cation generating unit 545 and the anion generating unit 547 according to the selection.

The cation generating unit 545 dissociates moisture (H2O) in the air by a plasma discharge to generate hydrogen ions (H+), and the anion generating unit 547 emits electrons. Hydrogen ions (H+) produced by the cation generating unit 545 transfer to the anion generating unit 547 along flow of the air.

Electrons emitted from the anion generating unit 547 are in an unstable state, and thus they strongly tend to combine with other atoms. Accordingly, some of the electrons combine with oxygen molecules (O2) in the air to generate superoxides (O2−), and the other electrons combine with hydrogen ions (H+) transferring from the cation generating unit 545 into hydrogen atoms (H). The thus formed hydrogen atoms (H) and superoxides (O2−) meet microorganisms and fine dust in the air.

Hereinafter, a process of generated ions sterilizing microorganisms will be explained.

Microorganisms in the air generally have positive static electricity, and so superoxides (O2−) having opposite polarity to the static electricity are drawn to the static electricity to be absorbed to the microorganisms. Further, hydrogen atoms (H) are absorbed to the superoxides (O2−) absorbed to the microorganisms.

In this process, hydrogen atoms (H) and superoxides (O2−) make a reaction to produce an intermediate substance, hydroperoxy radicals (HO2). Further, electrons that the superoxides (O2−) hold offset the static electricity of the microorganisms.

A hydroperoxy radical (HO2) takes three hydrogen atoms (H) from protein ingredients forming the cell membrane of the microorganisms to generate two water molecules (H2O). Through this chemical reaction, water (HO2) harmless to humans is produced, and the protein ingredients of the cell membrane of the microorganisms, which the hydrogen atoms (H) were taken from, i.e., the cell membrane of the microorganisms, are destroyed to achieve sterilization.

Meanwhile, a process of generated ions agglomerating fine dust will be explained.

Fine dust largely has positive static electricity, and thus negative superoxide (O2−) is drawn to the fine dust with positive static electricity with each other to be adsorbed to the fine dust. In this adsorption process, the superoxide (O2−) forms mutual attraction between fine dust particles floating in the air. That is, a plurality of fine dust particles are attracted to each other by the superoxide (O2−) so that they are agglomerated to extend a particle diameter.

The extension of the fine dust particles in diameter controls fine dust floating freely in the air and facilitates filtering fine dust by a separate filter (not shown), thereby purifying air.

In this manner, ions generated by the ion generating unit 545 and 547 sterilize microorganisms in the air and agglomerate fine dust to extend in particle diameter, thereby easily removing fine dust.

Meanwhile, the aforementioned embodiment has been described in the case that both cations and anions are generated, but is not limited thereto. For example, only one of cations and anions may be produced, and any of them may be generated relatively greater by adjusting an amount of each ion generated.

For example, if only anions are produced by the anion generating unit 547, superoxides (O2−) become greater in amount, which is favorable to elimination of fine dust. However, as hydrogen ions (H+) are not generated by the cation generating unit 545, an amount of hydrogen atoms (H) in the air becomes smaller. Thus, elimination of microorganisms is more favorable when both cations and anions are generated than when only anions are produced.

Meanwhile, if only cations are generated by the cation generating unit 545, hydrogen ions (H+) become greater in amount, but fine dust more tends to have positive static electricity than negative static electricity. Thus, this case may be unfavorable to elimination of fine dust as compared with when only anions are generated or both cations and anions are produced.

Figure 7:
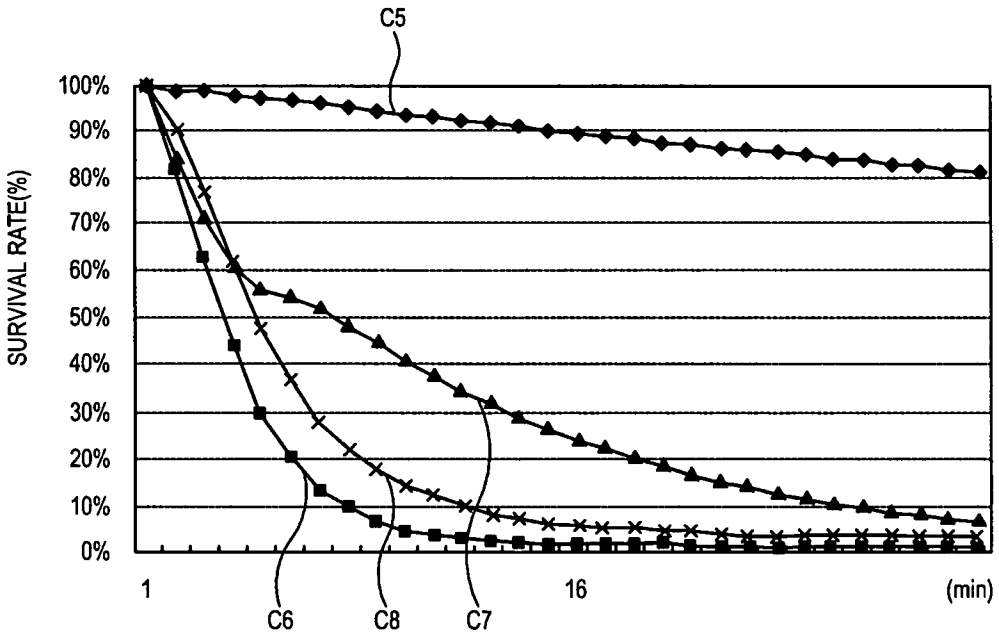
FIG. 7 is a graph illustrating measurement results of a degree of eliminating fine dust in air by the air purification module in FIG. 4.

This is also illustrated by a graph of experimental results in FIG. 7. FIG. 7 is a graph illustrating measurement results of a degree of eliminating fine dust in the air discharged from the air purification module 540 according to different cases when ions are generated by the air purification module 540.

In the graph of FIG. 7, the horizontal axis indicates time, and the vertical axis represents a survival rate of fine dust.

Curve C5 indicates a survival rate of fine dust in the air with time when neither cations nor anions are produced. When ions are not generated, fine dust in the air is hardly removed even after a lapse of time.

Curve C6 indicates a survival rate of fine dust in the air with time when only anions are produced, Curve C7 indicates one when only cations are produced, and Curve C8 indicates one when both cations and anions are produced.

According to these curves, elimination of fine dust is highly effective when only cations are produced as compared with when ions are not generated, and an elimination effect of fine dust is superior when only anions are generated or when both cations and anions are produced to when only cations are generated.

Considering only the elimination effect of fine dust, the case when only anions are produced is more efficient than the case when both cations and anions are generated. This is because superoxides (O2−) are generated greater in the former case than in the latter case, and some electrons generated by the anion generating unit 547 form hydrogen atom (H) so that an amount of superoxides (O2−) generated is relatively small as compared with in the former case.

However, in consideration of elimination of microorganisms, hydroperoxy radicals are easily generated when both cations and anions are produced, and thus sterilization of microorganisms is highly effective as compared with the other cases.

According to the present exemplary embodiment, a channel is formed to extend in a lengthwise direction of a heating roller adjacently to the heating roller of a fixing unit which is the highest area in temperature in an image forming apparatus, and air is allowed to be discharged out of the apparatus through the channel, thereby effectively reducing temperature in the image forming apparatus. Further, an air purification module purifying the air discharged through the channel is employed to minimize air contamination in use environments of the image forming apparatus.

Moreover, the channel is formed in a substantial straight line to minimize interference in air traveling, thereby improving cooling effects in the apparatus.

In addition, the air purification module selectively generates any of cations and anions or produces both cations and anions, thereby selectively dealing with elimination of fine dust in the air such as nano-dust and microorganisms such as bacteria according to use environments.

Finally, a user input unit which allows a user to select whether to generate cations and anions and selectively adjust an amount of ions generated is adopted, enabling air purification corresponding to changes in use environments of the image forming apparatus.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. An image forming apparatus comprising:

a body housing;

a paper feeding unit accommodated in the body housing to provide a recording medium;

an image forming unit accommodated in the body housing to form an image on the recording medium;

a fixing unit accommodated in the body housing to fix the image formed by the image forming unit; and a cooling unit which discharges heat generated in the fixing unit to the outside, the cooling unit comprising:

an inhalation part, a first channel, a second channel, and a discharging part, that are all formed in the body housing, for air to flow, wherein the first channel extending between the inhalation part and the second channel and formed in a straight line adjacently to the fixing unit, wherein the second channel is formed at one end of the first channel and perpendicular to the first channel, and comprises:

a fan, opposite to and facing the inhalation part, to draw air out of the first channel so that an air flow in the second channel is perpendicular to an air flow in the first channel, and an air purification module to generate ions reacting to foreign substances in air that traveled through the first channel and then passed through the fan to purify the air, wherein the fixing unit comprises a heating roller to generate heat, and the first channel is formed to extend in a lengthwise direction of the heating roller adjacently to the heating roller allowing the air to flow in the lengthwise direction of the heating roller, wherein the air purification module comprises a cation generating unit to produce cations and an anion generating unit installed distantly from the cation generating unit in a direction of air traveling to produce anions.

2. The image forming apparatus according to claim 1, wherein the air that passes through the fan and then the air purification module is then discharged out of the body housing in a direction perpendicular to the direction of air flow in the first channel.

3. The image forming apparatus according to claim 1, wherein the anion generating unit emits an electron to generate superoxide (O2−).

4. The image forming apparatus according to claim 1, wherein the cation generating unit generates a hydrogen ion (H+).

5. The image forming apparatus according to claim 4, wherein the air purification module produces a hydrogen atom (H) by operating both the cation generating unit and the anion generating unit.

6. The image forming apparatus according to claim 1, wherein the air purification module produces a hydrogen atom and superoxide, and produces hydroperoxy radical (HO2) with the hydrogen atom and the superoxide.

7. The image forming apparatus according to claim 1, further comprising a user input unit provided to select whether to produce ions by the air purification module and upon selecting that ions are to produced, adjusting an amount of at least one of produced cations and produced anions.

8. The image forming apparatus according to claim 1, wherein the inhalation part includes a hole penetrating the body housing to allow the inhalation of the air from outside the body housing.

9. A cooling unit of an image forming apparatus having a paper feeding unit, an image forming unit and a fixing unit accommodated in a body housing, the cooling unit comprising:

a first channel formed to extend in a straight line and lengthwise direction of a heating roller of the fixing unit adjacently to the heating roller so that air is discharged along the lengthwise direction of the heating roller out of the image forming apparatus through the first channel, a second channel, and a discharging part including a generating of ions to discharge heat generated in the fixing unit to the outside;

an inhalation part formed at an end of the first channel; and wherein the second channel is formed at another end of the first channel and perpendicular to the first-channel, wherein the inhalation part, the first channel, the second channel and the discharging part are formed in the body housing for air to flow, the first channel extending between the inhalation part and the second channel, wherein the second channel comprises:

a fan to draw air out of the channel so that an air flow in the second channel is perpendicular to an air flow in the first channel, and an air purification module to generate ions reacting to foreign substances in air that traveled through the channel, and passed through the fan, to purify the air, wherein the air purification module comprises a cation generating unit to produce cations and an anion generating unit installed distantly from the cation generating unit in a direction of air traveling to produce anions.

10. The cooling unit according to claim 9, wherein the anion generating unit emits an electron to generate superoxide (O2−).

11. The cooling unit according to claim 9, wherein the cation generating unit generates a hydrogen ion (H+).

12. The cooling unit according to claim 9, wherein the cation generating unit and the anion generating unit produces a hydrogen atom (H) by operating together.

13. The cooling unit according to claim 9, wherein the air purification module produces a hydrogen atom and superoxide, and produces hydroperoxy radical (HO2) with the hydrogen atom and the superoxide.

14. The cooling unit according to claim 9, further comprising a user input unit which allows a user to select whether to produce ions with the air purification module and upon selecting that ions are to produced, selectively to adjust an amount of at least one of produced cations and produced anions.

15. The cooling unit according to claim 9, wherein the inhalation part includes a hole penetrating the body housing to allow the inhalation of the air from outside the body housing.

* * * * *